US009336967B2

(12) United States Patent
Sakurazawa et al.

(10) Patent No.: US 9,336,967 B2
(45) Date of Patent: May 10, 2016

(54) SWITCH DEVICE AND TIMEPIECE

(71) Applicant: CASIO COMPUTER CO., LTD., Shibuya-ku, Tokyo (JP)

(72) Inventors: Naohiko Sakurazawa, Akishima (JP); Hajime Iguchi, Fuchu (JP); Yukio Funabara, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/848,336

(22) Filed: Sep. 9, 2015

(65) Prior Publication Data

US 2016/0093453 A1 Mar. 31, 2016

(30) Foreign Application Priority Data

Sep. 29, 2014 (JP) ..... 2014-198630

(51) Int. Cl.

| | |
|---|---|
| ***G04B 37/08*** | (2006.01) |
| ***H01H 13/06*** | (2006.01) |
| ***H01H 13/14*** | (2006.01) |
| ***G04B 37/10*** | (2006.01) |

(52) U.S. Cl.

CPC ..... *H01H 13/063* (2013.01); *G04B 37/106* (2013.01); *H01H 13/14* (2013.01); *H01H 2221/08* (2013.01); *H01H 2300/016* (2013.01)

(58) Field of Classification Search

CPC ..... G04B 37/106; G04B 37/02; G04B 37/04; G04B 37/08; H01H 2221/08; H01H 2300/016; H01H 13/14; H01H 13/063

USPC ..... 368/319

See application file for complete search history.

(56) References Cited

U.S. PATENT DOCUMENTS

| | | | | |
|---|---|---|---|---|
| 2,507,974 | A * | 5/1950 | Henry | G04B 37/10 368/288 |
| 8,408,785 | B2 * | 4/2013 | Hiranuma | G04B 37/02 368/291 |
| 8,419,269 | B2 * | 4/2013 | Hiranuma | G04B 37/08 368/291 |
| 2009/0147630 | A1 | 6/2009 | Clerc et al. | |
| 2015/0043314 | A1 * | 2/2015 | Hiranuma | G04B 3/048 368/308 |

FOREIGN PATENT DOCUMENTS

JP 2009133859 A 6/2009

* cited by examiner

*Primary Examiner* — Sean Kayes

(74) *Attorney, Agent, or Firm* — Holtz, Holtz & Volek PC

(57) ABSTRACT

A switch device including a case having a through hole, a cylindrical member including a first cylindrical section having a small diameter arranged in the through hole of the case and a second cylindrical section having a large diameter arranged on an outer portion of the case, an operation member including a shaft section slidably inserted into the first cylindrical section and a head section slidably arranged in the second cylindrical section, a waterproof member provided between an inner peripheral surface of the second cylindrical section and an outer peripheral surface of the head section, and a vent passage that allows air inside the second cylindrical section and air outside the case to pass through a vent hole provided in the cylindrical member and a gap between an outer surface of the cylindrical member and an outer surface of the case for ventilation.

20 Claims, 7 Drawing Sheets

SWITCH DEVICE AND TIMEPIECE

CROSS-REFERENCE TO RELATED APPLICATION

This application is based upon and claims the benefit of priority from the prior Japanese Patent Application No. 2014-198630, filed Sep. 29, 2014, the entire contents of which are incorporated herein by reference.

BACKGROUND OF THE INVENTION

1. Field of the Invention

The present invention relates to a switch device that is used in an electronic apparatus such as a timepiece, a cellular phone, and a portable terminal, and a timepiece.

2. Description of the Related Art

In recent years, a switch device for a wristwatch is known in which a mounting pipe is fitted into a fitting hole of a wristwatch case, a shaft portion of a button member is slidably inserted into the mounting pipe, the shaft portion of the button member protruding from the mounting pipe and the head of the shaft portion formed on its outer end are covered with a waterproof sheet, and the waterproof sheet is attached to the outer surface of the wristwatch case via a fixing member so as to achieve waterproofness, as described in Japanese Patent Application Laid-Open (Kokai) Publication No. 2009-133859.

This type of switch device having the waterproof sheet made of a soft synthetic resin such as urethane resin or silicone resin is structured such that, when the button member is pressed, the waterproof sheet deforms elastically in response to this press operation, and the elastic deformation of the waterproof sheet causes the button member to slide and come in contact with a switch contact inside the wristwatch case, which results in a switching operation.

However, in this switch device, the waterproof sheet is not easily deformed if it is thick, in which case a larger pressure load is required when the button member is pressed. As a result, the operability of the button member is deteriorated. If the waterproof sheet is thinner, it is elastically deformed more easily. However, in this case, the waterproof sheet is damaged more easily, and therefore the waterproofness cannot be ensured. In addition, since the waterproof sheet is made of a soft synthetic resin, it is easily deteriorated regardless of whether it is thick or thin.

An object of the present invention is to provide a switch device and a timepiece that can ensure waterproofness and improve operability.

SUMMARY OF THE INVENTION

In accordance with one aspect of the present invention, there is provided a switch device comprising: a case having a through hole; a cylindrical member including a first cylindrical section having a small diameter arranged in the through hole of the case and a second cylindrical section having a large diameter arranged on an outer portion of the case; an operation member including a shaft section slidably inserted into the first cylindrical section and ahead section slidably arranged in the second cylindrical section; a waterproof member provided between an inner peripheral surface of the second cylindrical section and an outer peripheral surface of the head section; and a vent passage that allows air inside the second cylindrical section and air outside the case to pass through a vent hole provided in the cylindrical member and a gap between an outer surface of the cylindrical member and an outer surface of the case for ventilation.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIGS. 4A and 4B depict a cylindrical member of the switch device of FIG. 2, of which FIG. 4A shows an enlarged front view of the cylindrical member and FIG. 4B shows an enlarged sectional view of the cylindrical member taken along line B-B in FIG. 4A;

DETAILED DESCRIPTION OF THE PREFERRED EMBODIMENTS

First Embodiment

Exercise Supporting Device

Hereafter, a first embodiment in which the present invention has been applied in a wristwatch will be described with reference to FIG. 1 to FIG. 5.

Figure 1:
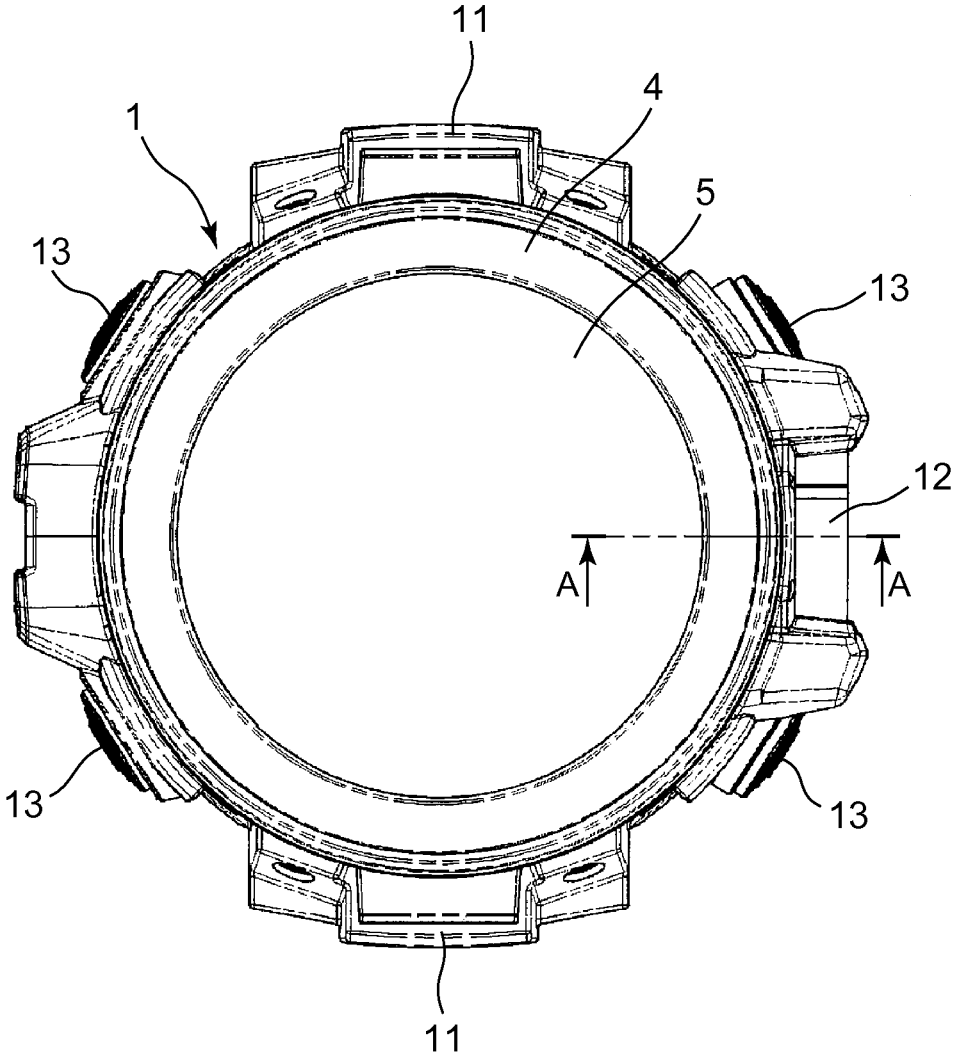
FIG. 1 is an enlarged front view of a first embodiment in which the present invention has been applied in a wristwatch.
Figure 2:
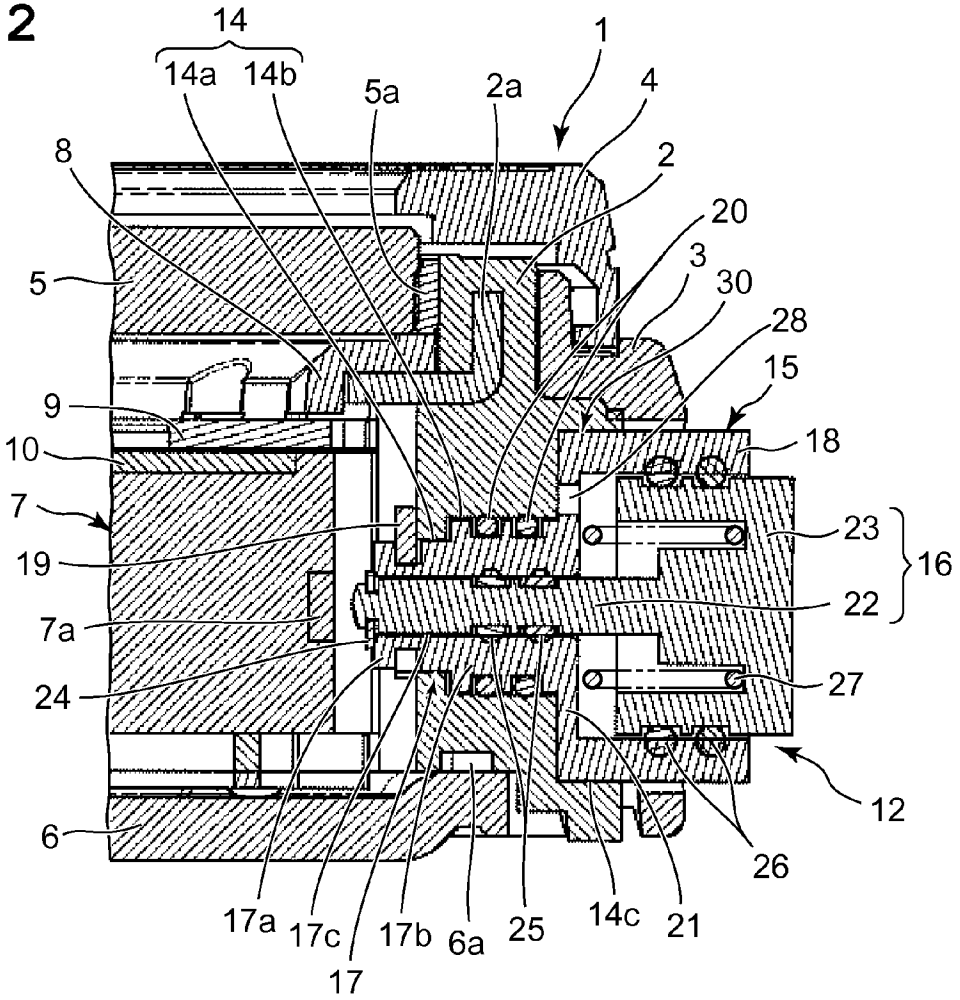
FIG. 2 is an enlarged sectional view of the main portion of the wristwatch taken along line A-A in FIG. 1.

As shown in FIG. 1 and FIG. 2, the wristwatch includes a wristwatch case 1, which is constituted by a body case 2, a first external case 3, and a second external case 4. The body case 2 is made of a hard synthetic resin and has a reinforcing metal member 2*a* embedded in the body case 2.

Figure 3:
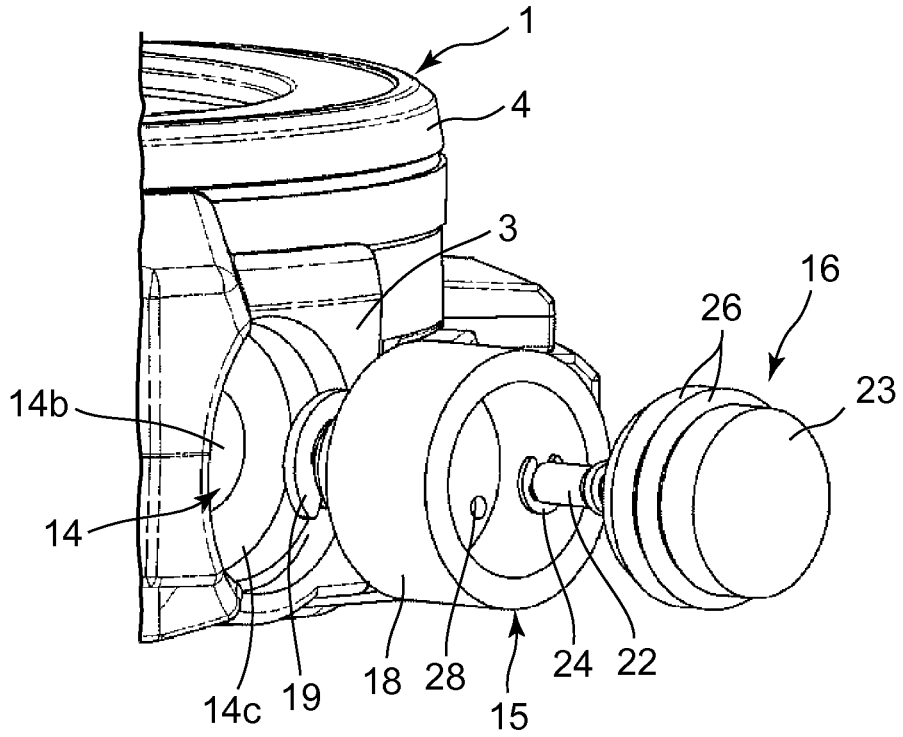
FIG. 3 is an enlarged exploded perspective view of the main portion of the switch device of FIG. 2.
Figure 4A:
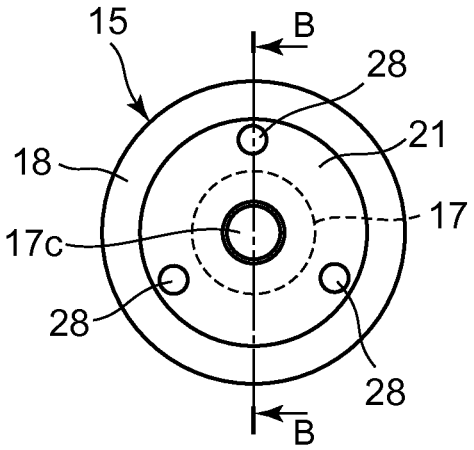
Figure 4B:
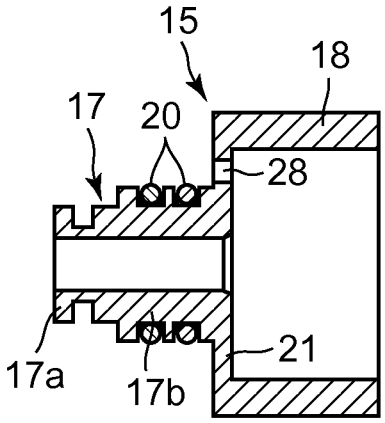

As shown in FIG. 1 to FIG. 3, the first external case 3 is made of a soft synthetic resin and attached to the outer periphery of the body case 2 so as to cover the outer periphery. The second external case 4 is made of a soft synthetic resin and attached to the upper outer periphery of the body case 2 and the upper outer periphery of the first external case 3 so as to cover these outer peripheries.

In an upper opening of the wristwatch case 1, that is, in an upper opening of the body case 2, a timepiece glass 5 is fitted via a packing 5*a*, as shown in FIG. 2. In this case, the outer peripheral edge of the upper surface of the timepiece glass 5 is covered by the second external case 4. To the lower portion of the wristwatch case 1, that is, to the lower portion of the body case 2, a rear case 6 is attached via a waterproof ring 6*a*.

Inside the wristwatch case 1, that is, inside the body case 2, a timepiece module 7 is arranged, as shown in FIG. 2. This timepiece module 7 has various components (not depicted) necessary for timepiece functions, such as a timepiece movement for driving hands and a display panel that electrooptically displays information including time information.

Between the timepiece module 7 and the timepiece glass 5, a ring-shaped parting member 8 is arranged, as shown in FIG. 2. This parting member 8 has its upper surface formed into a tilted surface tilting from the outer periphery side to the inner periphery side, on which hour markers (not depicted) have been provided circumferentially at equal intervals. Between the parting member 8 and the timepiece module 7, a first dial 9 and a second dial 10 above which the hands move are arranged to be vertically overlapped with each other.

On side portions on the 12 o'clock side and 6 o'clock side of the wristwatch case 1, band attachment sections 11 are provided projecting outward, as shown in FIG. 1. On a side portion on the 3 o'clock side of the wristwatch case 1, a switch device 12 is provided. On side portions on the 2 o'clock side, 4 o'clock side, 8 o'clock side, and 10 o'clock side of the wristwatch case 1, push-button switches 13 are provided, respectively.

The switch device 12 includes a cylindrical member 15 fitted into a through hole 14 formed on the body case 2 of the wristwatch case 1, and an operation member 16 inserted slidably into the cylindrical member 15 and protruding outside of the wristwatch case 1, as shown in FIG. 2 and FIG. 3. The through hole 14 is constituted by a small-diameter hole section 14*a* located closer to inside of the body case 2 and a large-diameter hole section 14*b* located closer to outside of the body case 2.

As shown in FIG. 2 and FIG. 3, a counterbore 14*c* is formed on the outer end of the large-diameter hole section 14*b*. The large-diameter hole section 14*b* of the through-hole has an axial length longer than the axial length of the small-diameter hole section 14*a* and the axial length of the counterbore 14*c*.

The cylindrical member 15 has a first cylindrical section 17 arranged in the through hole 14 of the body case 2, and a second cylindrical section 18 arranged outside the body case 2 and protruding from the first external case 3 toward the outside of the wristwatch case 1. Both cylindrical sections are made of a metal or hard synthetic resin and are formed integrally together, as shown in FIG. 2 to FIG. 4A and FIG. 4B. The first cylindrical section 17 has a small-diameter cylindrical section 17*a* inserted into the small-diameter hole section 14*a* of the through hole 14 of the body case 2, and a large-diameter cylindrical section 17*b* inserted into the large-diameter hole section 14*b* of the through hole 14 of the body case 2.

The small-diameter cylindrical section 17*a* has an axial length longer than the axial length of the small-diameter hole section 14*a* of the through hole 14, and an inner end protruding into the body case 2, as shown in FIG. 2. On the inner end of the small-diameter cylindrical section 17*a* protruding into the body case 2, a stopper 19, such as E-ring, is provided. As a result, the small-diameter cylindrical section 17*a* is structured such that its stopper 19 comes in contact with the inner peripheral surface of the body case 2 so as to prevent the cylindrical member 15 from slipping out of the body case 2.

The large-diameter cylindrical section 17*b* has an axial length equal to the axial length of the large-diameter hole section 14*b* of the through hole 14, as shown in FIG. 2. As a result, the large-diameter cylindrical section 17*b* is fitted into the large-diameter hole section 14*b* of the through hole 14. On the outer peripheral surface of the large-diameter cylindrical section 17*b*, multiple annular waterproof packings 20 are arranged, each of which is in pressure contact with the inner peripheral surface of the large-diameter hole section 14*b* of the through hole 14. Inside the large-diameter cylindrical section 17*b* and small-diameter cylindrical section 17*a*, a shaft insertion hole 17*c* is formed penetrating in the axial direction.

The second cylindrical section 18 has an outer diameter substantially equal to the inner diameter of the counterbore 14*c* of the through hole 14, and an inner diameter larger than the outer diameter of the large-diameter hole section 14*b* of the through hole 14, as shown in FIG. 2 and FIG. 3. The second cylindrical section 18 has an axial length substantially equal to the axial length of the first cylindrical section 17.

As a result, the second cylindrical section 18 is structured such that its outer end protrudes from the body case 2 toward the outside of the first external case 3 with its inner end on the body case 2 side being arranged inside the counterbore 14*c* of the through hole 14, as shown in FIG. 2 to FIG. 4A and FIG. 4B. In this structure, the second cylindrical section 18 has the inner diameter larger than the outer diameter of the large-diameter cylindrical section 17*b* of the cylindrical member 15.

Accordingly, the second cylindrical section 18 is structured such that the inner end of the second cylindrical section 18 on the body case 2 side is connected to the outer end of the large-diameter cylindrical section 17*b* of the first cylindrical section 17 via a connecting section 21, as shown in FIG. 2 and FIG. 3. As a result, when the inner end of the second cylindrical section 18 on the body case 2 side is arranged inside the counterbore 14*c* of the through hole 14, the outer surface of the connecting section 21 comes in contact with the inner surface of the counterbore 14*c*.

As a result, the stopper 19 attached to the inner end of the small-diameter cylindrical section 17*a* of the first cylindrical section 17 comes in contact with the inner peripheral surface of the body case 2 with the large-diameter cylindrical section 17*b* of the first cylindrical section 17 being fitted into the large-diameter hole section 14*b* of the through hole 14 of the body case 2, and the outer surface of the connecting section 21 of the second cylindrical section 18 comes in contact with the inner surface of the counterbore 14*c* of the through hole 14, whereby the cylindrical section 15 is fitted into the through hole 14 of the body case 2 without rattling in the axial direction, as shown in FIG. 2 and FIG. 3.

The operation member 16 has a shaft section 22 which is slidably inserted into the shaft insertion hole 17*c* of the first cylindrical section 17 of the cylindrical member 15 fitted into the through hole 14 of the body case 2, and a head section 23 which is formed on the outer end of the shaft section 22 and slidably arranged in the second cylindrical section 18 of the cylindrical member 15, as shown in FIG. 2 and FIG. 3.

The shaft section 22 has an outer diameter substantially equal to the inner diameter of the shaft insertion hole 17*c* of the first cylindrical section 17, and an axial length longer than the axial length of the first cylindrical section 17, as shown in FIG. 2 and FIG. 3. As a result, when the shaft section 22 is inserted into the shaft insertion hole 17*c* of the first cylindrical section 17, the inner end of the shaft section 22 protrudes into the body case 2 and the outer end thereof protrudes into the second cylindrical section 18 of the cylindrical member 15.

In this embodiment, a stopper 24, such as E-ring, is attached to the inner end of the shaft section 22 protruding into the body case 2, as shown in FIG. 2 and FIG. 3. This stopper 24 comes in contact with the inner end of the small-diameter cylindrical section 17*a* of the first cylindrical section 17 which is protruding into the body case 2, and thereby prevents the shaft section 22 from coming out of the body case 2.

The shaft section 22 is structured such that its inner end can come in contact with and separate from a switch contact 7*a* formed on the timepiece module 7 in the body case 2, as shown in FIG. 2 and FIG. 3. As a result, by the inner end of the shaft section 22 protruding into the body case 2 and pressing the switch contact 7*a* in response to a press operation on the head section 23, the switch contact 7*a* performs a switching operation.

On the outer periphery of the shaft section 22, multiple annular waterproof rings 25 are arranged, as shown in FIG. 2 and FIG. 3. These waterproof rings 25 slidably comes in pressure contact with the inner peripheral surface of the shaft insertion hole 17*c* of the first cylindrical section 17 and, in this state, slide along the inner peripheral surface of the shaft insertion hole 17*c* of the first cylindrical section 17 along with a slide action of the shaft section 22.

The head section 23 is integrally formed on the outer end of the shaft section 22 protruding into the second cylindrical section 18 of the cylindrical member 15, as shown in FIG. 2 and FIG. 3. The head section 23 is substantially cylindrical as a whole and slidably arranged in the second cylindrical section 18 of the cylindrical member 15. The head section 23 has an outer diameter equal to the inner diameter of the second cylindrical section 18 of the cylindrical member 15, and an inner diameter equal to or slightly larger than the outer diameter of the large-diameter cylindrical section 17*b* of the first cylindrical section 17.

The head section 23 has an axial length substantially equal to the axial length of the second cylindrical section 18 of the cylindrical member 15, as shown in FIG. 2 and FIG. 3. As a result, when the stopper 24 of the shaft section 22 comes in contact with the inner end of the small-diameter cylindrical section 17*a* of the first cylindrical section 17, the head section 23 is arranged in the second cylindrical section 18 of the cylindrical member 15 in a manner to be slidable in its axial direction, with the inner end surface of the head section 23 being separated from the connecting section 21 of the second cylindrical section 18 and the outer end of the head section 23 protruding from the second cylindrical section 18 of the cylindrical member 15 toward the outside of the wristwatch case 1.

On the outer peripheral surface of the head section 23, multiple annular waterproof members 26 are arranged, as shown in FIG. 2 and FIG. 3. The waterproof members 26, which have a ring shape, slidably come in pressure contact with the inner peripheral surface of the second cylindrical section 18 of the cylindrical member 15 and, in this state, slide along the inner peripheral surface of the second cylindrical section 18 of the cylindrical member 15 along with a slide action of the head section 23.

Inside the head section 23, a coil spring 27 is arranged along the outer periphery of the shaft section 22, as shown in FIG. 2. This coil spring 27 is structured such that its one end comes in resilient contact with the outer end of the large-diameter cylindrical section 17*b* of the cylindrical member 15, and the other end comes in resilient contact with the inner end face of the head section 23, and the coil spring 27 in this state forces the head section 23 in a direction where the head section 23 protrude toward the outside of the body case 2.

The switch device 12 has a vent passage 30 that allows air inside the second cylindrical section 18 and air outside the wristwatch case 1 to pass through multiple vent holes 28 formed in the connecting section 21 of the cylindrical member 15 and through a gap S between the outer surface of the body case 2 and the outer surface of the cylindrical member 15 for ventilation, as shown in FIG. 2 to FIG. 5. The vent holes 28 are formed in the connecting section 21 on the boundary between the first cylindrical section 17 and the second cylindrical section 18 such that the vent holes 28 inwardly and outwardly penetrate the second cylindrical section 18.

The outer surface of the body case 2 and the outer surface of the cylindrical member 15 have fine irregularities provided thereon by surface processing. The surface processing is hairline processing or satin processing by which fine lines or irregularities are formed on the outer surface of the body case 2 and the outer surface of the cylindrical member 15. Between the outer surface of the body case 2 and the outer surface of the cylindrical member 15, the tiny gap S for ventilation is formed by the fine irregularities formed by the surface processing, as shown in FIG. 5.

Figure 5:
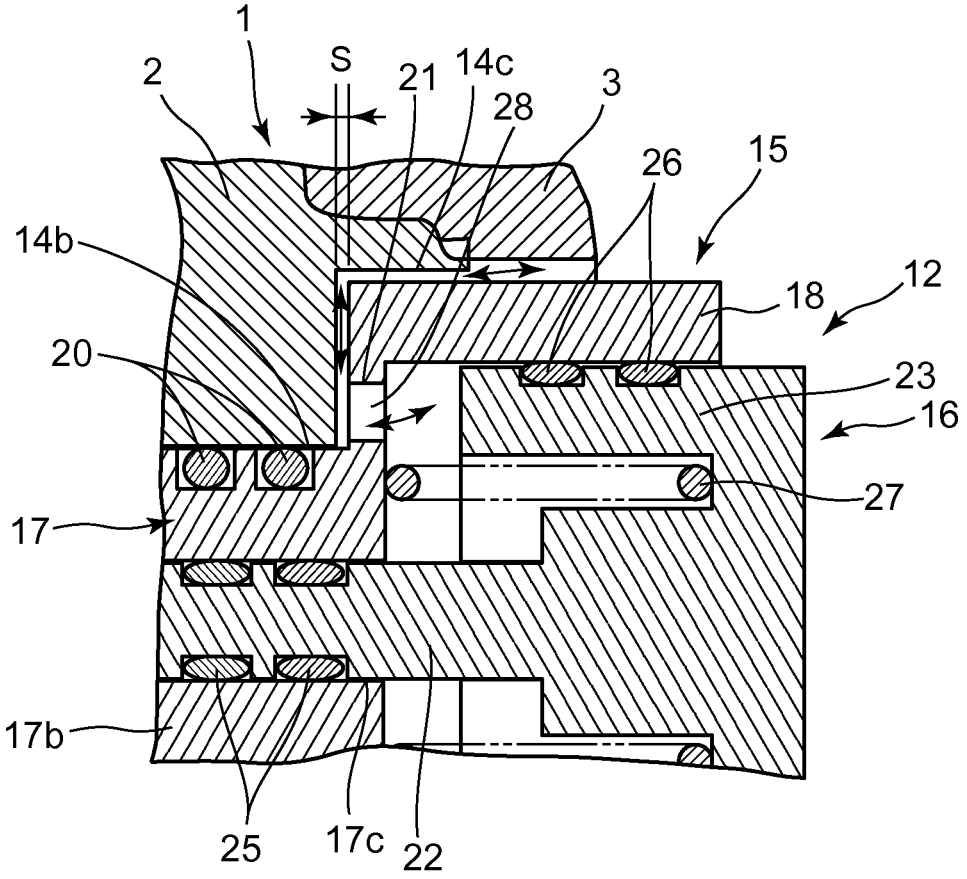
FIG. 5 is an enlarged sectional view of the main portion of the switch device of FIG. 2, in which a vent passage of the switch device of FIG. 2 is shown.

As a result, the vent passage 30 is structured such that, when the head section 23 of the operation member 16 is pressed into the body case 2, air inside the internal space of second cylindrical section 18 which is enclosed by the second cylindrical section 18 of the cylindrical member 15 and the head section 23 of the operation member 16 is sent to the tiny gap S between the outer surface of the body case 2 and the outer surface of the cylindrical member 15 through the vent holes 28 of the connecting section 21, and then released to the outside of the wristwatch case 1 through the tiny gap S between the outer surface of the body case 2 and the outer surface of the cylindrical member 15, as shown in FIG. 2 and FIG. 5.

Also, the vent passage 30 is structured such that, when the head section 23 of the operation member 16 is pressed toward outside of the body case 2 by the spring force of the coil spring 27, air outside the wristwatch case 1 is sent to the tiny gap S between the outer surface of the body case 2 and the outer surface of the cylindrical member 15, sent to the vent holes 28 of the connecting section 21 through the tiny gap 5, and then sent from the vent holes 28 to the internal space of second cylindrical section 18 which is enclosed by the second cylindrical section 18 of the cylindrical member 15 and with the head section 23 of the operation member 16, as shown in FIG. 2 and FIG. 5.

Next, the operation of the switch device 12 of the wristwatch is described. When the switch device 12 is in the normal state, the head section 23 has been pressed toward the outside of the wristwatch case 1 by the spring force of the coil spring 27 arranged inside the second cylindrical section 18 of the cylindrical member 15 and the head section 23 of the operation member 16.

In this state, the stopper 24 attached to the inner end of the shaft section 22 of operation member 16 protruding into the body case 2 is in contact with the inner end of the small-diameter cylindrical section 17*a* of first cylindrical section 17 which is protruding into the body case 2, and the outer end of the head section 23 is protruding from the second cylindrical section 18 to the outside of the wristwatch case 1, with the inner end of the head section 23 of the operation member 16 being separated from the connecting section 21 of the second cylindrical section 18 of the cylindrical member 15.

As a result, the inner end of the shaft section 22 of the operation member 16 is away from the switch contact 7*a* formed on the timepiece module 7, whereby the switch contact 7*a* is in an off state. In this state, when the head section 23 of the operation member 16 is pressed against the spring force of the coil spring 27, the shaft section 22 of the operation member 16 slides into the body case 2 through the shaft insertion hole 17*c* of the first cylindrical section 17 of the cylindrical member 15.

Here, the waterproof rings 25 arranged on the outer peripheral surface of the shaft section 22 also slide while being in pressure contact with the inner peripheral surface of the shaft insertion hole 17*c* of the first cylindrical section 17. Similarly, the waterproof rings 26 arranged on the outer peripheral surface of the head section 23 slide while being in pressure contact with the inner peripheral surface of the second cylindrical section 18 of the cylindrical member 15. Accordingly, by the waterproof rings 26, foreign objects such as water and dirt from the outside of the wristwatch case 1 do not enter the second cylindrical section 18 through a gap between the outer peripheral surface of the head section 23 and the inner peripheral surface of the second cylindrical section 18, which makes the second cylindrical section 18 waterproof and airtight.

During this sliding action, air inside the internal space of second cylindrical section 18 which is enclosed by the second cylindrical section 18 of the cylindrical member 15 and the head section 23 of the operation member 16 is gradually compressed as the head section 23 slides toward the body case 2, whereby the air pressure is increased. This compressed air is released to the outside of the wristwatch case 1 through the vent passage 30.

Specifically, the compressed air is sent into the tiny gap S between the outer surface of the body case 2 and the outer surface of the cylindrical member 15 through the vent holes 28 of the connecting section 21, and released to the outside of the wristwatch case 1 through the tiny gap S between the outer surface of the body case 2 and the outer surface of the cylindrical member 15. Accordingly, even when the head section 23 is slid, the air pressure in the internal space of second cylindrical section 18 which is enclosed by the second cylindrical section 18 of the cylindrical member 15 and the head section 23 of the operation member 16 is kept substantially equal to the air pressure outside the wristwatch case 1.

For this reason, even when the head section 23 of the operation member 16 is pressed and air inside the internal space of second cylindrical section 18 which is enclosed by the second cylindrical section 18 of the cylindrical member 15 and the head section 23 of the operation member 16 is compressed, the operation member 16 can be slid smoothly. Here, the inner end of the shaft section 22 is pressed into the body case 2 along with the sliding movement of the operation member 16, whereby the inner end of the shaft section 22 comes in contact with the switch contact 7*a* of the timepiece module 7 and presses the switch contact 7*a* to perform a switch-on operation.

After the switch contact 7*a* is pressed to perform the switch-on operation, the head section 23 is pressed toward outside of the wristwatch case 1 by the spring force of the coil spring 27 arranged inside the second cylindrical section 18 of the cylindrical member 15 and the head section 23 of the operation member 16. At this time as well, the shaft section 22 of the operation member 16 slides toward the outside of the wristwatch case 1 through the shaft insertion hole 17*c* of the first cylindrical section 17 of the cylindrical member 15, during which the waterproof rings 25 arranged on the outer peripheral surface of the shaft section 22 also slide while being in pressure contact with the inner peripheral surface of the shaft insertion hole 17*c* of the first cylindrical section 17.

At this time as well, the waterproof rings 26 arranged on the outer peripheral surface of the head section 23 also slide while being in pressure contact with the inner peripheral surface of the second cylindrical section 18 of the cylindrical member 15. Accordingly, by the waterproof rings 26, foreign objects such as water and dirt from the outside of the wristwatch case 1 do not enter the second cylindrical section 18 through a gap between the outer peripheral surface of the head section 23 and the inner peripheral surface of the second cylindrical section 18, which keeps the second cylindrical section 18 waterproof and airtight.

During this sliding action, air inside the internal space of second cylindrical section 18 which is enclosed by the second cylindrical section 18 of the cylindrical member 15 and the head section 23 of the operation member 16 is gradually expanded as the head section 23 slides toward the outside of the wristwatch case 1, whereby the air pressure is decreased. When the air pressure gradually decreases in this manner, air outside the wristwatch case 1 is sent to the second cylindrical section 18 of the cylindrical member 15 through the vent passage 30.

Specifically, air outside the wristwatch case 1 is sent into the tiny gap S between the outer surface of the body case 2 and the outer surface of the cylindrical member 15, sent to the vent holes 28 of the connecting section 21 through the tiny gap S, and then sent from the vent holes 28 to the inside of the cylindrical section 18 of the cylindrical member 15. Accordingly, even when the head section 23 is slid, the air pressure in the internal space of second cylindrical section 18 which is enclosed by the second cylindrical section 18 of the cylindrical member 15 and the head section 23 of the operation member 16 is kept substantially equal to the air pressure outside the wristwatch case 1.

Accordingly, even when air inside the internal space of second cylindrical section 18 which is enclosed by the second cylindrical section 18 of the cylindrical member 15 and the head section 23 of the operation member 16 is expanded by the operation member 16 being slid back to its original position by the spring force of the coil spring 27, and the air pressure is decreased thereby, the operation member 16 can be slid smoothly. Here, the inner end of the shaft section 22 is separated from the switch contact 7*a* of the timepiece module 7 along with the sliding movement of the operation member 16, which shifts the switch contact 7*a* to an off state.

As described above, the switch device 12 of this wristwatch includes the cylindrical member 15 having the first cylindrical section 17 arranged in the through hole 14 of the body case 2 and the second cylindrical section 18 arranged outside the body case 2, the operation member 16 having the shaft section 22 inserted into the first cylindrical section 17 and the head section 23 arranged inside the second cylindrical section 18, the waterproof members 26 arranged between the inner peripheral surface of the second cylindrical section 18 and the outer peripheral surface of the head section 23, and the vent passage 30 that allows air inside the second cylindrical section 18 and air outside the wristwatch case 1 to pass through the vent holes 28 formed on the connecting section 21 of the cylindrical member 15 and the gap S between the outer surface of the cylindrical member 15 and the outer surface of the body case 2 for ventilation, whereby the waterproofness is ensured and the operability is improved.

Specifically, in the switch device 12 of the wristwatch, the waterproof members 26 ensure the waterproofness and the airtightness between the inner peripheral surface of the second cylindrical section 18 of the cylindrical member 15 and the outer peripheral surface of the head section 23 of the operation member 16, and the vent passage 30 allows air inside the second cylindrical section 18 and air outside the wristwatch case 1 to pass through for ventilation, which allows the air pressure in the internal space of second cylindrical section 18 enclosed by the head section 23 and the second cylindrical section 18 to be kept substantially equal to the air pressure outside the wristwatch case 1. As a result, the operability of the operation member 16 can be improved with the waterproofness and the airtightness being ensured by the waterproof members 26.

In this embodiment, the outer surface of the cylindrical member 15 which is located in an area where air flows, that is, the respective outer surfaces of the connecting section 21 and second cylindrical section 18 of the cylindrical member 15, and the outer surface of the body case 2 corresponding to those outer surfaces are provided with the fine irregularities formed by surface processing. These fine irregularities create the tiny space S between the outer surface of the cylindrical member 15 and the outer surface of the body case 2, whereby air is circulated through this tiny space S.

Also, being created as a tiny space by the fine irregularities formed by the surface processing, the space S between the outer surface of the cylindrical member 15 and the outer surface of the body case 2 allows air to pass through but does not allow foreign objects such as dirt to pass through, so that the dustproofness is ensured.

As a result, in the switch device 12, when the head section 23 of the operation member 16 is pressed and air inside the second cylindrical section 18 is compressed by the head section 23, the compressed air is sent into the tiny gap S between the outer surface of the body case 2 and the outer surface of the cylindrical member 15 through the vent holes 28 of the connecting section 21, and then released to the outside of the wristwatch case 1 through the tiny gap S.

Accordingly, in the switch device 12, when the head section 23 of the operation member 16 is pressed to cause the head section 23 to slid, the air pressure in the internal space of second cylindrical section 18 which is enclosed by the second cylindrical section 18 of the cylindrical member 15 and the head section 23 of the operation member 16 is kept substantially equal to the air pressure outside the wristwatch case 1. As a result, the operation member 16 can be smoothly and preferably slid.

Also, in the switch device 12, even when the operation member 16 is pressed toward the outside of the wristwatch case 1 and whereby air inside the second cylindrical section 18 is expanded and the air pressure is decreased along with the sliding movement of the head section 23, air outside the wristwatch case 1 is taken into the tiny gap S between the outer surface of the body case 2 and the outer surface of the cylindrical member 15, sent to the vent holes 28 of the connecting section 21 through the tiny gap S, and then sent from the vent holes 28 to the inside of the cylindrical section 18.

Accordingly, in the switch device 12, even when the head section 23 is slid by the operation member 16 being pressed toward the outside of the wristwatch case 1, the air pressure in the internal space of second cylindrical section 18 which is enclosed by the second cylindrical section 18 of the cylindrical member 15 and the head section 23 of the operation member 16 is kept substantially equal to the air pressure outside the wristwatch case 1. As a result, the operation member 16 can be smoothly and preferably slid.

Moreover, in the switch device 12, the inner end of the first cylindrical section 17 of the cylindrical member 15, which is located on the inner side of the body case 2, protrudes into the body case 2, and the stopper 19 is attached to this protruding portion. Accordingly, the stopper 19 can be brought into contact with the inner peripheral surface of the body case 2, which prevents the cylindrical member 15 from slipping out of the through hole 14 of the body case 2 toward the outside of the body case 2. As a result, the cylindrical member 15 can be securely fitted into the through hole 14 of the body case 2.

In this embodiment, the waterproof packings 20 are provided between the outer peripheral surface of the first cylindrical section 17 of the cylindrical member 15 and the inner peripheral surface of the through hole 14 of the body case 2. These waterproof packings 20 ensure waterproofness and airtightness between the outer peripheral surface of the first cylindrical section 17 and the inner peripheral surface of the through hole 14, and thereby unfailingly prevents water, air, and the like from entering the body case 2 through a gap between the outer peripheral surface of the first cylindrical section 17 and the inner peripheral surface of the through hole 14.

Second Embodiment

Next, a second embodiment in which the present invention has been applied in a wristwatch is described with reference to FIG. 6 and FIG. 7. Note that sections identical to those of the first embodiment shown in FIG. 1 to FIG. 5 are provided with the same reference numerals.

Figure 6:
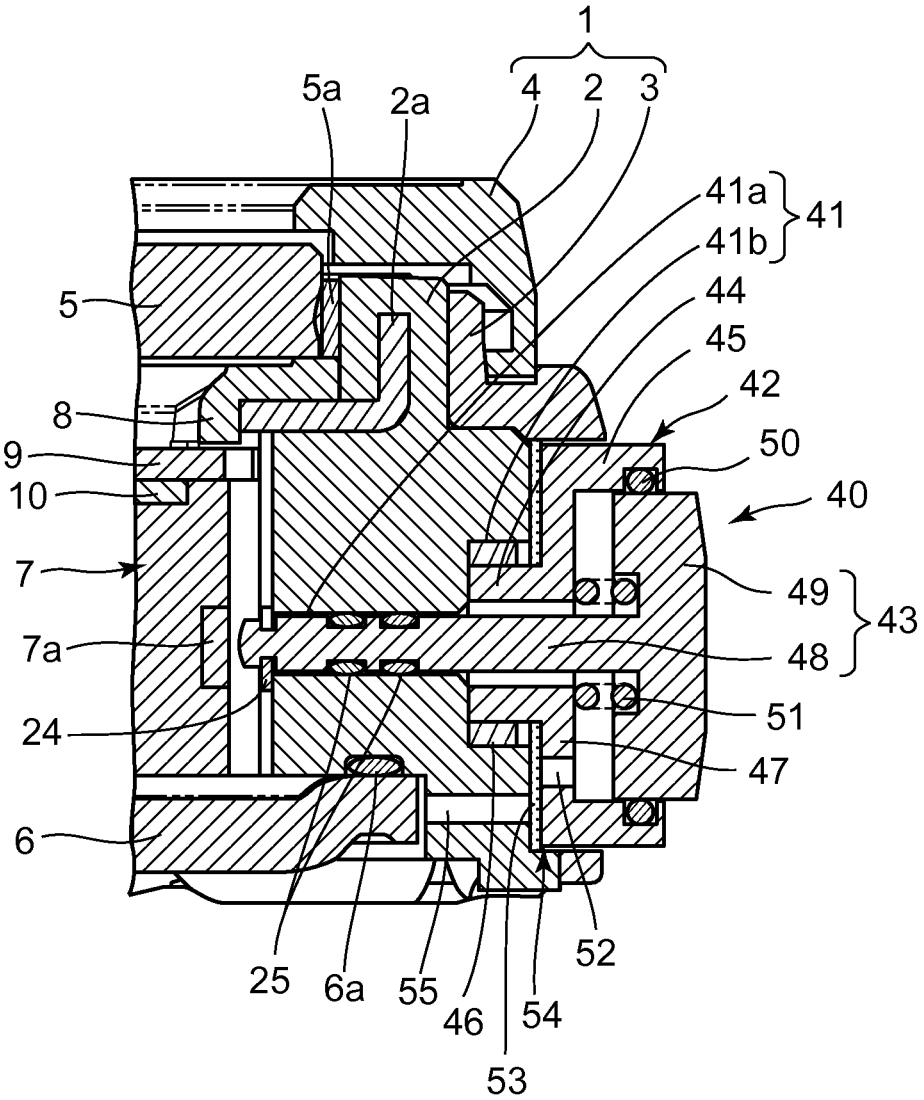
FIG. 6 an enlarged sectional view of the main portion of a second embodiment in which the present invention has been applied in a wristwatch.

As shown in FIG. 6, the wristwatch of the second embodiment has the same structure as that of the first embodiment except that the structure of a switch device 40 is different from that of the first embodiment.

This switch device 40 includes a cylindrical member 42 fitted into a through-hole 41 formed on the body case 2 of the wristwatch case 1, and an operation member 43 slidably inserted into the cylindrical member 42 and protruding outside of the wristwatch case 1, as shown in FIG. 6. The through-hole 41 has a small-diameter hole section 41*a* located on the inner side of the body case 2, and a large-diameter hole section 41*b* located on the outer side of the body case 2. The small-diameter hole section 41*a* has an axial length longer than that of the large-diameter hole section 41*b*.

The cylindrical member 42 has a first cylindrical section with a small-diameter which is arranged in the large-diameter hole section 41*b* of the through-hole 41, and a second cylindrical section 45 with a large-diameter which protrudes from the outer surface of the body case 2 toward the outside of the first external case 3, as shown in FIG. 6. The first cylindrical section 44 is press-fitted into the large-diameter hole section 41*b* of the through-hole 41 via waterproof packings 46.

That is, the first cylindrical section 44 has an outer diameter smaller than the inner diameter of the large-diameter hole section 41*b* of the through-hole 41, and an axial length equal to the axial length of the large-diameter hole section 41*b*. The first cylindrical section 44 has an inner diameter substantially equal to the inner diameter of the small-diameter hole section 41*a* of the through-hole 41, as shown in FIG. 6. As a result, the first cylindrical section 44 having the waterproof packings 46 arranged on the outer periphery thereof is press-fitted in the large-diameter hole section 41*b* and fixed therein.

As in the case of the first embodiment, the second cylindrical section 45 has an outer diameter larger than the inner diameter of the large-diameter hole section 41*b* of the through-hole 41, and an inner diameter also larger than the inner diameter of the large-diameter hole section 41*b* of the through-hole 41. The second cylindrical section 45 has an axial length longer than the axial length of the first cylindrical section 44. As a result, the second cylindrical section 45 is structured such that its outer end projects outside of the first external case 3 with its inner end surface on the body case 2 side being positioned near the outer surface of the body case 2.

Here, the inner end of second cylindrical section 45 on the body case 2 side is connected to the outer end of the first cylindrical section 44 via a connecting section 47, as shown in FIG. 6. As a result, the cylindrical member 42 is structured such that, when the first cylindrical section 44 is fitted into the large-diameter hole section 41*b* of the through-hole 41 via the waterproof packings 46, the outer end of the second cylindrical section 45 protrudes outside of the first external case 3 with the connecting section 47 of the second cylindrical section 45 being positioned near the inner surface of the large-diameter hole section 41*b*.

The operation member 43 has a shaft section 48 slidably inserted into the first cylindrical section 44 of the cylindrical member 42 fitted in the through-hole 41 of the body case 2 and into the small-diameter hole section 41*a* of the through-hole 41, and a head 49 formed on the outer end of the shaft section 48 and slidably arranged in the second cylindrical section 45 of the cylindrical member 42, as shown in FIG. 6.

The shaft section 48 is structured such that its inner end protrudes into the body case 2 and its outer end protrudes into the second cylindrical section 45 of the cylindrical member 42, as shown in FIG. 6. To the inner end of the shaft section 48 projecting into the body case 2, the stopper 24, such as E-ring, is attached, as in the case of the first embodiment. The stopper 24 comes in contact with the inner peripheral surface of the body case 2, and thereby prevents the shaft section 48 from coming out of the body case 2.

The inner end of the shaft section 48 can come in contact with and separate from the switch contact 7*a* formed on the timepiece module 7 in the body case 2, as shown in FIG. 6. On the outer periphery of the shaft section 48, the multiple annular waterproof rings 25 are arranged, as with the first embodiment. In addition, on the outer end of the shaft section 48, the head 49 is formed integrally.

The head 49 has a substantially disc shape as a whole and is slidably arranged in the second cylindrical section 45 of the cylindrical member 42, as shown in FIG. 6. Specifically, the head 49 has an outer diameter equal to the inner diameter of the second cylindrical section 45, and an axial length substantially equal to the axial length of the second cylindrical section 45 of the cylindrical member 42.

As a result, when the stopper 24 of the shaft section 48 comes in contact with the inner peripheral surface of the body case 2, the head 49 is arranged to be slidable in its axial direction in the second cylindrical section 45 of the cylindrical member 42 with the inner end face of the head 49 being separated from the connecting section 47 of the second cylindrical section 45 and the outer end of the head 49 protruding from the second cylindrical section 45 of the cylindrical member 42 toward the outside of the wristwatch case 1, as shown in FIG. 6.

On the outer peripheral surface of the head 49, annular waterproof members 50 are arranged, as shown in FIG. 6. The waterproof members 50, which have a ring shape, slidably come in pressure contact with the inner peripheral surface of the second cylindrical section 45 of the cylindrical member 42, and slide along the inner peripheral surface of the second cylindrical section 45 of the cylindrical member 42 along with a slide action of the head 49, as with the first embodiment.

Inside the head 49, a coil spring 51 is arranged along the outer periphery of the shaft section 48, as shown in FIG. 6. The coil spring 51 is structured such that its one end comes in resilient contact with the outer end of the first cylindrical section 44 of the cylindrical member 42, the other end comes in resilient contact with the inner end face of the head 49, and the coil spring 49 in this sate forces the head 49 in a direction where the head 49 is pressed toward the outside of the body case 2.

Figure 7:
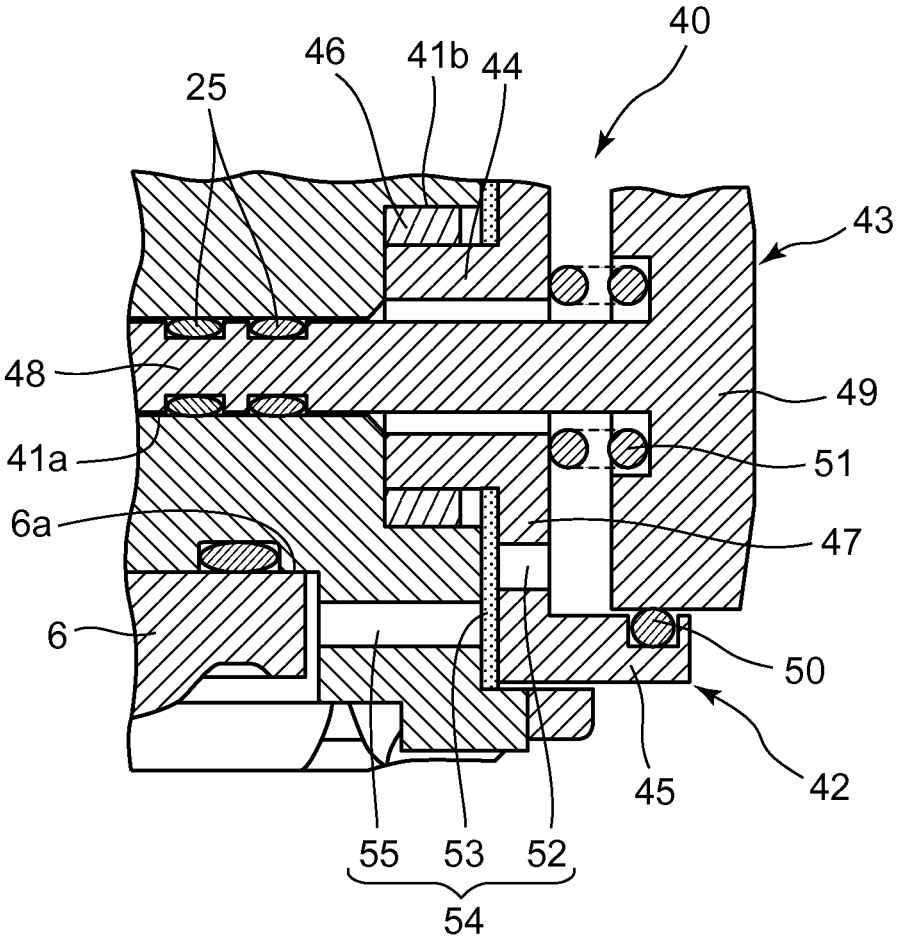
FIG. 7 is an enlarged sectional view of the main portion of the switch device of FIG. 6, in which a vent passage of the switch device of FIG. 6 is shown.

Also, the switch device 40 has a vent passage 54 that allows air inside the second cylindrical section 45 and air outside the wristwatch case 1 to pass through multiple vent holes 52 formed on the connecting section 47 of the cylindrical member 42 and a vent filter 53 arranged between the outer surface of the body case 2 and the outer surface of the cylindrical member 42 for ventilation, as shown in FIG. 6 and FIG. 7.

The vent holes 52 are formed on the connecting section 47 on the boundary between the first cylindrical section 44 and the second cylindrical section 45 such that the vent holes 52 inwardly and outwardly penetrate the second cylindrical section 45, as in the case of the first embodiment. The vent filter 53 is structured such that it allows gas and liquid, such as air and water, to pass through but do not allow foreign objects, such as dirt, to pass through. As shown in FIG. 7, the vent filter 53 is arranged between the outer surface of the cylindrical member 42, that is, the outer surface of the connecting section 47 of the second cylindrical section 45, and the outer surface of the body case 2 that corresponds to the outer surface of the connecting section 47.

As a result, the vent passage 54 is structured such that, when the head 49 of the operation member 43 is pressed into the body case 2, air inside the internal space of second cylindrical section 45 which is enclosed by the second cylindrical section 45 of the cylindrical member 42 and the head 49 of the operation member 43 is sent to the vent filter 53 between the outer surface of the body case 2 and the outer surface of the cylindrical member 42 through the vent holes 52 of the connecting section 47, and released to the outside of the wristwatch case 1 through the vent filter 53, as shown in FIG. 6 and FIG. 7.

The vent passage 54 is also structured such that, when the head 49 of the operation member 43 is pressed toward the outside of the body case 2, air outside the wristwatch case 1 is taken into the vent filter 53 between the outer surface of the body case 2 and the outer surface of the cylindrical member 42, sent to the vent holes 52 of the connecting section 47 through the vent filter 53, and then sent from the vent holes 52 into the internal space of second cylindrical section 45 which is enclosed by the second cylindrical section 45 and the head 49, as shown in FIG. 6 and FIG. 7.

Also, on the lower portion of the body case 2, an auxiliary vent hole 55 is formed, as shown in FIG. 6 and FIG. 7. The auxiliary vent hole 55 is formed on the lower portion of the body case 2 such that the inner end, that is, one end of the auxiliary vent hole 55 opposes the vent filter 53 and the outer end, that is, the other end of the auxiliary vent hole 55 opposes the outer peripheral surface of the rear case 6.

When air inside the second cylindrical section 45 is to be released to the outside of the wristwatch case 1 through the vent holes 52 and vent filter 53, the auxiliary vent hole 55 leads part of the air to the outer peripheral surface of the rear case 6 so that part of the air is sent from the outer peripheral surface of the rear case 6 to the outside of the wristwatch case 1, as shown in FIG. 6 and FIG. 7.

When air outside the wristwatch case 1 is to be taken into the vent filter 53, part of the air is taken from the outer peripheral surface side of the rear case 6 into the auxiliary vent hole 55, sent to the vent filter 53, and then sent from the vent holes 52 to the inside of the second cylindrical section 45, as shown in FIG. 6 and FIG. 7.

As described above, the switch device 40 of the wristwatch includes the waterproof members 50 arranged between the inner peripheral surface of the second cylindrical section 45 and the outer peripheral surface of the head 49, and the vent passage 54 that allows air inside the second cylindrical section 45 and air outside the body case 2 to pass through the vent holes 52 formed on the connecting section 47 of the cylindrical member 42 and through the vent filter 53 arranged between the outer surface of the cylindrical member 42 and the outer surface of the body case 2 for ventilation. As a result, the waterproofness is ensured and the operability is improved, as with the first embodiment.

That is, in the switch device 40 of the second embodiment as well, the waterproof members 50 ensure waterproofness and airtightness between the inner peripheral surface of the second cylindrical section 45 of the cylindrical member 42 and the outer peripheral surface of the head 49 of the operation member 43, and the vent passage 54 allows air inside the second cylindrical section 45 and air outside the body case 2 to pass through for ventilation, whereby the air pressure in the internal space of second cylindrical section 45 which is enclosed by the head 49 and the second cylindrical section 45 can be kept substantially equal to the air pressure outside the wristwatch case 1. As a result, the operability of the operation member 43 can be improved with the waterproofness and the airtightness being ensured by the waterproof members 50.

In this embodiment, between the outer surface of cylindrical member 42 that is located in a place where air flows, that is, the outer surface of the connecting section 47 of the cylindrical member 42, and the outer surface of the body case 2 corresponding to the outer surface of the connecting section 47, the vent filter 53 allowing air to pass therethrough is provided. This vent filter 53 allows air to pass therethrough but blocks foreign objects, such as dirt. Accordingly, the dustproofness is ensured.

As a result, in the switch device 40, even when the head 49 of the operation member 43 is pressed and air inside the second cylindrical section 45 is compressed by the head 49, the compressed air can be sent to the vent filter 53 between the outer surface of the body case 2 and the outer surface of the cylindrical member 42 through the vent holes 53 of the connecting section 47, and released to the outside of the wristwatch case 1 through the vent filter 53.

Accordingly, in this switch device 40 as well, when the head 49 of the operation member 43 is pressed to cause the head 49 to slid, the air pressure in the internal space of second cylindrical section 45 which is enclosed by the second cylindrical section 45 of the cylindrical member 42 and the head 49 of the operation member 43 is kept substantially equal to the air pressure outside the wristwatch case 1, whereby the operation member 43 can be preferably and smoothly slid, as in the case of the first embodiment.

Also, in the switch device 40, even when the operation member 43 is pressed toward the outside of the wristwatch case 1 and whereby air inside the second cylindrical section 45 is expanded and the air pressure is decreased along with the sliding movement of the head 49, air outside the wristwatch case 1 can be taken into the vent filter 53 between the outer surface of the body case 2 and the outer surface of the cylindrical member 42, sent to the vent holes 52 of the connecting section 47 through the vent filter 53, and sent from the vent holes 52 to the inside of the cylindrical section 45.

Accordingly, in this switch device 40 as well, when the operation member 43 is pressed toward the outside of the wristwatch case 1 to cause the head 49 to slid, the air pressure in the internal space of second cylindrical section 45 which is enclosed by the second cylindrical section 45 of the cylindrical member 42 and the head 49 of the operation member 43 is kept substantially equal to the air pressure outside the wristwatch case 1, whereby the operation member 43 can be smoothly and preferably slid, as in the case of the first embodiment.

Moreover, in the switch device 40, even if liquid such as water infiltrates into the second cylindrical section 45 of the cylindrical member 42, it is discharged out of the wristwatch case 1 through the capillary phenomenon of the vent filter 53, and thereby is not accumulated inside the second cylindrical section 45 of the cylindrical member 42. That is, a rust-preventing effect is achieved and the operability of the operation member 43 is ensured, so that the operation member 43 can be operated preferably and smoothly.

Furthermore, in the switch device 40, the auxiliary vent hole 55 is formed in the lower portion of the body case 2 such that its inner end, that is, one end opposes the vent filter 53 and its outer end, that is, the other end opposes the outer peripheral surface of the rear case 6. Through this auxiliary vent hole 55, part of air inside the second cylindrical section 45 is released to the outside of the wristwatch case 1 and part of air outside the wristwatch case 1 is sent to the inside of the second cylindrical section 45. As a result, the air pressure inside the second cylindrical section 45 is kept substantially equal to the air pressure outside the wristwatch case 1, whereby the operability of the operation member 43 can be improved.

That is, in the switch device 40, when the head 49 of the operation member 43 is pressed to send air inside the second cylindrical section 45 to the vent filter 53 between the outer surface of the body case 2 and the outer surface of the cylindrical member 42 through the vent holes 53 of the connecting section 47 and send the air to the outside of the wristwatch case 1 through the vent filter 53, part of the air is lead to the outer peripheral of the rear case 6 and sent therefrom to the outside of the wristwatch case 1.

Therefore, in the switch device 40, when the head 49 of the operation member 43 is pressed, air inside the second cylindrical section 45 is discharged more quickly than the case of the first embodiment. Accordingly, when the head 49 is slid, the air pressure in the internal space of second cylindrical section 45 which is enclosed by the second cylindrical section 45 of the cylindrical member 42 and the head 49 of the operation member 43 quickly becomes substantially equal to the air pressure outside the wristwatch case 1. As a result, the operation member 43 can be slid more smoothly and preferably.

Still further, in the switch device 40, when the operation member 43 is pressed toward the outside of the wristwatch case 1 so that air outside the wristwatch case 1 is taken into the vent filter 53 between the outer surface of the body case 2 and the outer surface of the cylindrical member 42, sent to the vent holes 52 of the connecting section 47 through the vent filter 53, and sent from the vent holes 52 to inside of the second cylindrical section 45, part of the air can be taken from the outer peripheral surface side of the rear case 6 and sent to the inside of the second cylindrical section 45 through the vent holes 52.

Accordingly, in the switch device 40, when the operation member 43 is pressed toward the outside of the wristwatch case 1, air outside the wristwatch case 1 is sent to the inside of the second cylindrical section 45 more quickly than the case of the first embodiment. Accordingly, when the head 49 is slid, the air pressure in the internal space of second cylindrical section 45 which is enclosed by the second cylindrical section 45 of the cylindrical member 42 and the head 49 of the operation member 43 quickly becomes substantially equal to the air pressure outside the wristwatch case 1. As a result, the operation member 43 can be slid more smoothly and preferably.

Yet still further, in the switch device 40, the first cylindrical section 44 of the cylindrical member 42 is press-fitted into the through-hole 41 and fixed therein with the waterproof packings 46 being interposed between the outer peripheral surface of the first cylindrical section 44 and the inner peripheral surface of the through-hole 41 of the body case 2. In this structure, the cylindrical member 42 can be fitted into the through-hole more easily with fewer components as compared to the case of the cylindrical member 15 of the first embodiment.

That is, the cylindrical member 42 can be easily and unfailingly fitted into the through-hole 41 only by arranging the waterproof packings 46 between the outer peripheral surface of the first cylindrical section 44 and the inner peripheral surface of the large-diameter hole section 41*b* of the through-hole 41 of the body case 2 and press-fitting the first cylindrical section 44 into the large-diameter hole section 41*b* of the through-hole 41.

In the second embodiment, the first cylindrical section 44 of the cylindrical member 42 is press-fitted into the large-diameter hole section 41*b* of the through-hole 41 via the waterproof packings 46. However, the present invention is not limited thereto and the same structure as the first embodiment may be adopted. Also, the vent filter 53 may be arranged in the tiny space S between the outer surface of the body case 2 and the outer surface of the cylindrical member 15, as described in the first embodiment.

Also, in the second embodiment, the auxiliary vent hole 55 is provided in the lower portion of the body case 2. However, the auxiliary vent hole 55 is not necessarily required to be provided.

Moreover, the structures of the switch devices of the first and second embodiments and modifications thereof may be applied in all types of switches including the push-button switches 13 attached to the wristwatch or may be applied to some of those switches.

Furthermore, in the first and second embodiments and modifications thereof, the present invention has been applied in a wristwatch. However, the present invention is not necessarily required to be applied in a wristwatch, and can be applied in various timepieces, such as travel watches, alarm clocks, table clocks, and wall clocks. In addition, the present invention is not necessarily required to be applied in timepieces, and can be widely applied in electronic apparatuses, such as cellular phones and portable information terminals.

While the present invention has been described with reference to the preferred embodiments, it is intended that the invention be not limited by any of the details of the description therein but includes all the embodiments which fall within the scope of the appended claims.

What is claimed is:

1. A timepiece comprising:

a switch device, wherein the switch device includes:

a case having a through hole;

a cylindrical member including a first cylindrical section having a small diameter arranged in the through hole of the case and a second cylindrical section having a large diameter arranged on an outer portion of the case;

an operation member including a shaft section slidably inserted into the first cylindrical section and ahead section slidably arranged in the second cylindrical section;

a waterproof member provided between an inner peripheral surface of the second cylindrical section and an outer peripheral surface of the head section; and a vent passage that allows air inside the second cylindrical section and air outside the case to pass through a vent hole provided in the cylindrical member and a gap between an outer surface of the cylindrical member and an outer surface of the case for ventilation.

2. A switch device comprising:

a case having a through hole;

a cylindrical member including a first cylindrical section having a small diameter arranged in the through hole of the case and a second cylindrical section having a large diameter arranged on an outer portion of the case;

an operation member including a shaft section slidably inserted into the first cylindrical section and a head section slidably arranged in the second cylindrical section;

a waterproof member provided between an inner peripheral surface of the second cylindrical section and an outer peripheral surface of the head section; and a vent passage that allows air inside the second cylindrical section and air outside the case to pass through a vent hole provided in the cylindrical member and a gap between an outer surface of the cylindrical member and an outer surface of the case for ventilation.

3. The switch device according to claim 2, wherein the outer surface of the cylindrical member and the outer surface of the case in areas where air flows are provided with fine irregularities formed by surface processing.

4. The switch device according to claim 3, wherein the first cylindrical section of the cylindrical member is press-fitted into the through hole and fixed, with a waterproof packing being interposed between an outer peripheral surface of the first cylindrical section and an inner peripheral surface of the through hole of the case.

5. The switch device according to claim 3, wherein a vent filter where air passes through is provided between the outer surface of the cylindrical member and the outer surface of the case in areas where air flows.

6. The switch device according to claim 5, wherein the first cylindrical section of the cylindrical member has an inner end located on an inner side of the case and protruding into the case, and the projecting inner end is attached with a stopper.

7. The switch device according to claim 6, wherein a waterproof packing is provided between an outer peripheral surface of the first cylindrical section of the cylindrical member and an inner peripheral surface of the through hole of the case.

8. The switch device according to claim 5, wherein a waterproof packing is provided between an outer peripheral surface of the first cylindrical section of the cylindrical member and an inner peripheral surface of the through hole of the case.

9. The switch device according to claim 3, wherein the first cylindrical section of the cylindrical member has an inner end located on an inner side of the case and protruding into the case, and the projecting inner end is attached with a stopper.

10. The switch device according to claim 9, wherein a waterproof packing is provided between an outer peripheral surface of the first cylindrical section of the cylindrical member and an inner peripheral surface of the through hole of the case.

11. The switch device according to claim 3, wherein a waterproof packing is provided between an outer peripheral surface of the first cylindrical section of the cylindrical member and an inner peripheral surface of the through hole of the case.

12. The switch device according to claim 2, wherein a vent filter where air passes through is provided between the outer surface of the cylindrical member and the outer surface of the case in areas where air flows.

13. The switch device according to claim 12, wherein the first cylindrical section of the cylindrical member is press-fitted into the through hole and fixed, with a waterproof packing being interposed between an outer peripheral surface of the first cylindrical section and an inner peripheral surface of the through hole of the case.

14. The switch device according to claim 12, wherein the first cylindrical section of the cylindrical member has an inner end located on an inner side of the case and protruding into the case, and the projecting inner end is attached with a stopper.

15. The switch device according to claim 14, wherein a waterproof packing is provided between an outer peripheral surface of the first cylindrical section of the cylindrical member and an inner peripheral surface of the through hole of the case.

16. The switch device according to claim 12, wherein a waterproof packing is provided between an outer peripheral surface of the first cylindrical section of the cylindrical member and an inner peripheral surface of the through hole of the case.

17. The switch device according to claim 2, wherein the first cylindrical section of the cylindrical member has an inner end located on an inner side of the case and protruding into the case, and the projecting inner end is attached with a stopper.

18. The switch device according to claim 17, wherein a waterproof packing is provided between an outer peripheral surface of the first cylindrical section of the cylindrical member and an inner peripheral surface of the through hole of the case.

19. The switch device according to claim 2, wherein a waterproof packing is provided between an outer peripheral surface of the first cylindrical section of the cylindrical member and an inner peripheral surface of the through hole of the case.

20. The switch device according to claim 2, wherein the first cylindrical section of the cylindrical member is press-fitted into the through hole and fixed, with a waterproof packing being interposed between an outer peripheral surface of the first cylindrical section and an inner peripheral surface of the through hole of the case.

* * * * *